US005568955A

United States Patent [19]

Giuliano et al.

[11] Patent Number: 5,568,955

[45] Date of Patent: Oct. 29, 1996

[54] DEVICE FOR INDIVIDUAL COLLECTION OF PET EXCREMENTS

[76] Inventors: Mary-Louise Giuliano; Yuri Tuvim, both of 22 Jenison St., Newton, Mass. 02160

[21] Appl. No.: 532,232

[22] Filed: Sep. 22, 1995

[51] Int. Cl.[6] ..... A01K 29/00

[52] U.S. Cl. ..... 294/1.3; 294/25

[58] Field of Search ..... 294/1.3, 25; 2/16, 2/20, 159, 167; 15/104.8, 227; 119/161; 206/223, 496; 383/42, 70, 71, 77

[56] References Cited

U.S. PATENT DOCUMENTS

| | | | |
|---|---|---|---|
| 4,645,251 | 2/1987 | Jacobs | 294/1.3 |
| 4,677,697 | 7/1987 | Hayes | 294/1.3 X |
| 4,788,733 | 12/1988 | Lerner | 294/1.3 X |
| 4,845,781 | 7/1989 | Strickland et al. | 294/1.3 X |
| 4,902,283 | 2/1990 | Rojko et al. | 294/1.3 X |
| 4,937,881 | 7/1990 | Heise | 294/1.3 X |
| 5,149,159 | 9/1992 | Bardes | 294/1.3 |

FOREIGN PATENT DOCUMENTS

| | | | |
|---|---|---|---|
| 2645188 | 10/1990 | France | 294/1.3 |
| 2649143 | 1/1991 | France | 294/1.3 |
| 2237973 | 5/1991 | United Kingdom | 294/1.3 |

*Primary Examiner*—Johnny D. Cherry
*Attorney, Agent, or Firm*—Ilya Zborovsky

[57] ABSTRACT

A device for individual collection of pet excrements has a substantially elongated element having a first hollow portion formed to receive a user's palm and provided with a projection for receiving a user's thumb, and a second portion extending from the first portion and having an inlet opening for insertion of the user's arm, the second portion having a length which is at least equal to a length of the first portion, and a width which is at least equal to the width of the first portion, so that when a user by manipulations with the first portion and the projection collects the pet excrements, the second portion can be turned over the first portion and farther so that the element is turned inside out to produce a bag-like structure with excrements inside.

5 Claims, 2 Drawing Sheets

DEVICE FOR INDIVIDUAL COLLECTION OF PET EXCREMENTS

BACKGROUND OF THE INVENTION

The present invention relates to a device for individual collection of pet excrements.

Devices of the above mentioned general type are known in the art. Some of such devices disclose shovels of various types, scooping elements, scrapers arranged on an end of a stick and some are provided with automatic closing and opening features, etc. Known devices of this type are generally relatively complicated and/or relatively expensive. Also, they have to be cleaned since they are produced generally as non-disposable devices for multiple use. It is believed that it is advisable to further improve such devices.

SUMMARY OF THE INVENTION

Accordingly, it is an object of the present invention to provide a device for individual collection of pet excrements, which avoids the disadvantages of the prior art and is a further improvement of the existing devices.

In keeping with these objects and with others which will become apparent hereinafter, one feature of the present invention resides, briefly stated, in a device for individual collection of pet excrements, comprising an elongated hose-shaped element having a first portion adapted to fit on a user's palm and provided with at least one hollow projection movable relative to said first portion so that excrements can be picked by the user's thumb accommodated in the first portion with additional manipulations by the projection, and a second portion extending from the first portion in a longitudinal direction and having an opening for insertion of the user's arm, said second portion has a length which is at least equal to the length of the first portion and a width which is at least equal to the width of the first portion so that the second portion can be turned over onto the first portion and be on the first portion to form a receptacle in which the collected excrements are accommodated.

The device in accordance with the present invention is formed as a one-piece integral element composed of a plastic, preferably of a biodegradable plastic.

When the device is designed in accordance with the present invention, a person puts his arm into the device, then by manipulation of the first portion and the projections takes the excrement from the ground and holds it and then turns the second portion over the first portion and farther so as to turn the whole device inside out and accommodate the collected excrements inside the device which forms a receptacle. Then the extreme part of the second portion can be tied up so as to form an enclosed bag-like receptacle which can be disposed since on the one hand it is very cheap and on the other hand is composed of a biodegradable material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
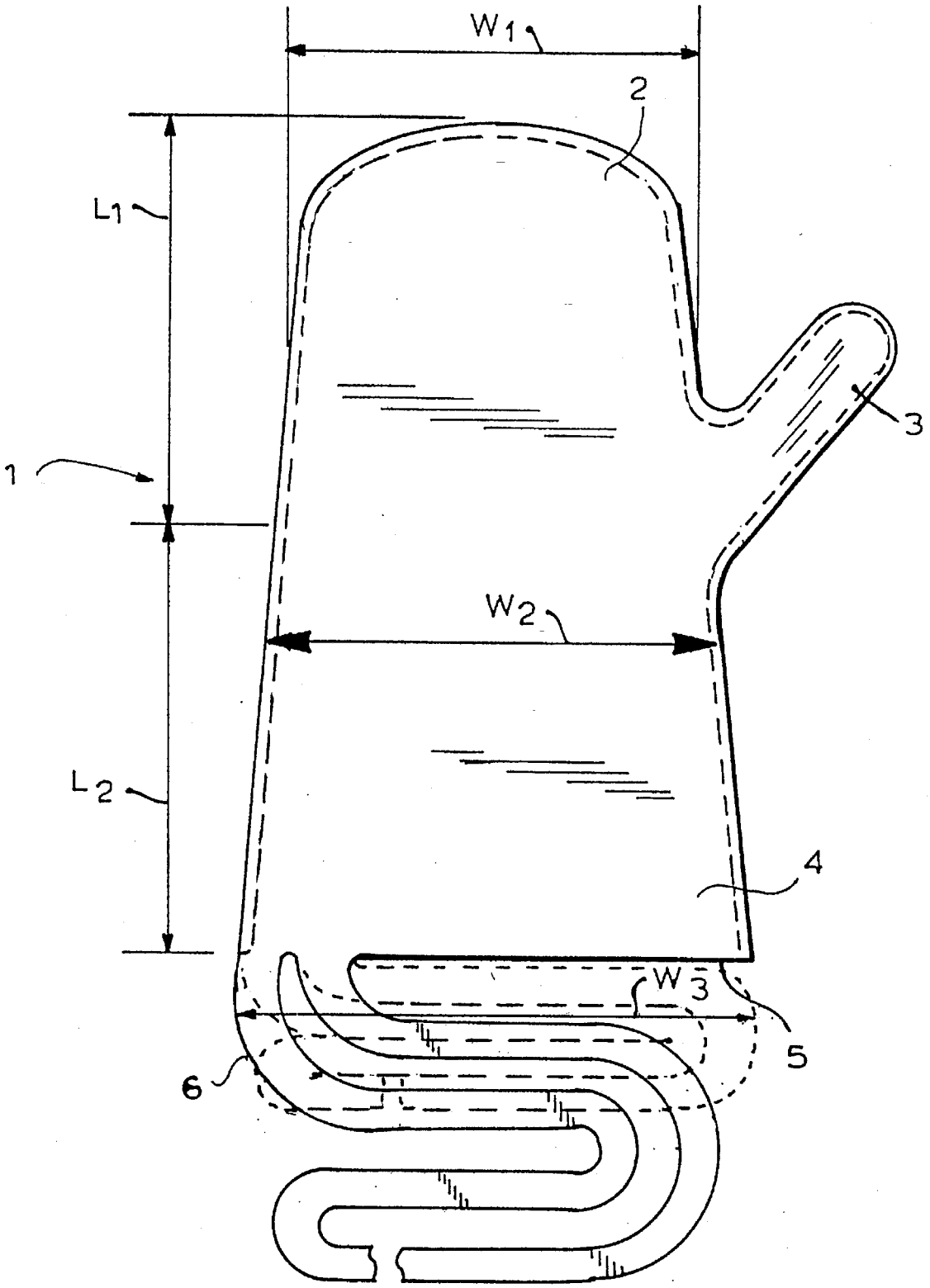
FIG. 1 is a view showing a device for individual collection of pet excrements in an initial position.

A device for individual collection of pet excrements in accordance with the present invention is identified as a whole with reference numeral 1. It is formed as a hose-shaped elongated element which is composed of plastic, preferably of a biodegradable plastic. The element has a first hollow portion which is identified with reference numeral 2. The first hollow portion is closed at all sides with the exception of a rear side so that the user's palm can be introduced into the first portion and be completely accommodated there. A hollow projection 3 extends laterally from the first portion 2 and can accommodate a user's thumb. The parts 2, 3 serve for collecting pet excrements from the ground and other places.

A second portion 4 extends rearwardly from the first portion 2 and is open at its rear end. The user can insert his arm into the device through a rear opening 5 and then push it all the way into the first portion 2 with the thumb inserted in the projection 3.

In accordance with the present invention, the second portion 4 has a length L2 which is at least equal to the length L1 of the first portion. Preferably the length L2 of the second portion 4 is greater than the length L1 of the first portion. The second portion 4 also has a width W2 in the region in which it is connected with the first portion 2 which width W2 is at least equal to the width W1 of the first portion 2. Preferably, the width W2 is somewhat greater and increases in direction toward the rear opening 5 when it reaches the value W3.

The device is further provided with means for closing the device after the excrements have been collected and are accommodated in the device. The closing means include a meandering strap 6 formed as a rear part of the second portion 4 by providing a plurality of transverse cuts in the rear part. In an inoperative position the strap 6 is coextensive with the second section 4, while in an operative position the strap 6 is unfolded and forms an elongated element which is convenient to tie up the device, as will be explained hereinbelow. The meandering strap 6 can be formed of one piece with the remaining part of the device in a single manufacturing process with both ends connected to it.

Figure 2:
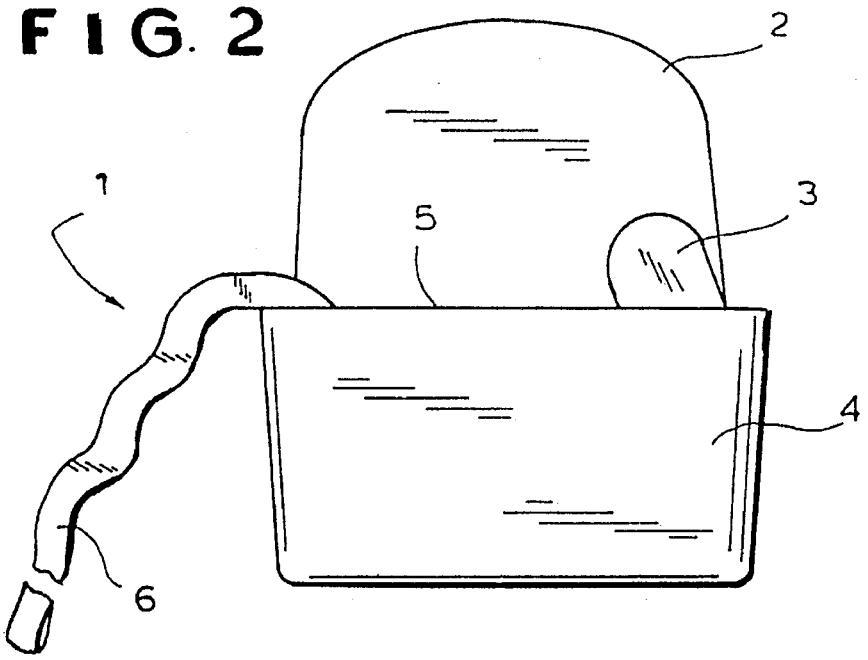
FIG. 2 is a view showing the device partly inverted during operation.
Figure 3:
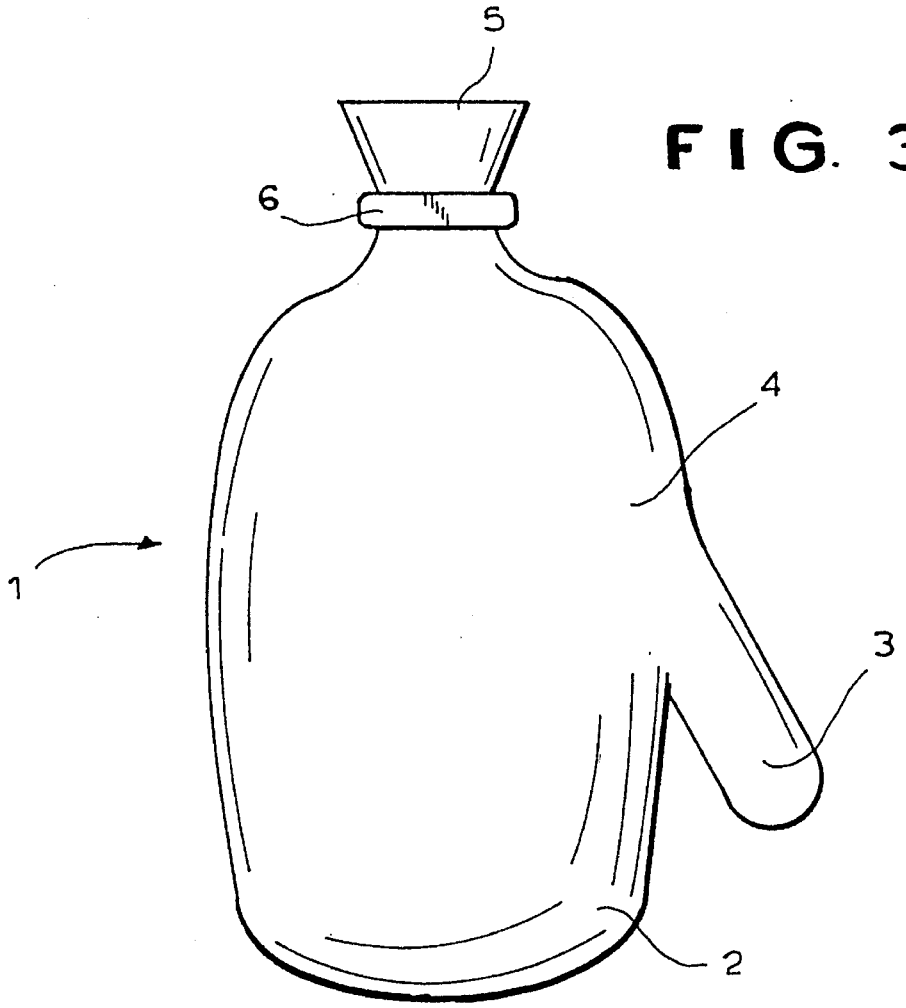
FIG. 3 is a view showing the inventive device in its final position with the collected excrements inside.

The device operates in the following manner:

In order to collect excrement the user puts his arm into the device in the position shown in FIG. 1 with his palm inserted into the first portion 2 and his thumb inserted into the projection 3. The excrements, for example, are located on the ground, and the user puts his arm with the device on it on top of the excrements. Then by manipulations of the arm with the portion 2 and the projection 3, he scoops the excrements from the ground and holds it in his arm. Thereafter, with a second arm, he starts turning the second portion 4 onto the first portion 2 as shown in FIG. 2, and finally, turns the whole device inside out. In the position shown in FIG. 3 the device is turned inside out, the user's arm is released and the excrements are located inside the device. Then the strap 6 is tied around a part of the portion 5, and a closed bag with the excrements inside is therefore produced. Since the device is composed of an inexpensive polymeric material and since the material is biodegradable, the device can be immediately discarded.

It will be understood that each of the elements described above, or two or more together, may also find a useful application in other types of constructions differing from the types described above.

While the invention has been illustrated and described as embodied in a device for individual collection of pet excrements, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for individual collection of pet excrements, comprising a substantially elongated element having a first hollow portion formed to receive a user's palm and provided with a projection for receiving a user's thumb, and a second portion extending from said first portion and having an inlet opening for insertion of the user's arm, said second portion having a length which is at least equal to the length of said first portion, and a width which is at least equal to the width of said first portion, so that when a user by manipulations with the first portion and the projection collects the pet excrements, the second portion can be turned over the first portion and farther so that said element is turned inside out to produce a bag-like structure with excrements inside; and means for closing said element after it has been converted inside out, said closing means being a strap formed as a rear part of said second portion which is formed of one piece with a remaining part of said second portion and includes a plurality of transverse cuts, said rear part in an inoperative position being coextensive with said second portion while in an operative position said strap being unfolded and forming an elongated element for tying up the device with both ends of said strap which are connected of one piece to the remaining part of said second portion.

2. A device as defined in claim 1, wherein said element is composed of a biodegradable plastic.

3. A device as defined in claim 1, wherein said second portion has a width which increases in direction from a region in which it is connected with said first portion to said insertion opening.

4. A device as defined in claim 1, wherein said strap and said first and second portions together are formed of one piece with one another so that said element is a one-piece element.

5. A method of individual collection of pet excrements, comprising providing an elongated element having a first hollow portion with a projection, and a second portion extending longitudinally from the first portion and having a length which is at least equal to the length of the first portion and a width which is at least equal to the width of the first portion; inserting a user's arm into the element so that a user's palm is located in the first portion and a user's thumb is located in the projection; collecting the excrements by manipulating the first portion and the projection; turning the second portion out of the first portion and farther so as to turn the element inside out and so as to form a bag-like structure with the collected excrements inside it; forming means for closing the element after it has been converted inside out, said forming including forming said closing means as a strap formed as a rear part of the second portion which rear part is formed of one piece with the remaining part of said second portion and provided with a plurality of transverse cuts; arranging the strap in an inoperative position so that it is coextensive with the second portion; and unfolding the strap in an operative position so as to form an elongated element for tying up the element and having two ends connected with the remaining part of the second portion of one piece with the second portion.

* * * * *